US006059630A

United States Patent [19]

Paxton et al.

[11] Patent Number: 6,059,630

[45] Date of Patent: May 9, 2000

[54] LOG BASED ASSEMBLY SET

[76] Inventors: Earl L. Paxton; Laramie S. Paxton, both of 12370 Dexter Chelsea Rd., Chelsea, Mich. 48118

[21] Appl. No.: 09/120,020

[22] Filed: Jul. 21, 1998

[51] Int. Cl.[7] ..... A63H 33/08

[52] U.S. Cl. ..... 446/106; 446/124; 446/476

[58] Field of Search ..... 52/233, 272, 668; 446/106, 108, 110, 114, 124, 476

[56] References Cited

U.S. PATENT DOCUMENTS

| | | | |
|---|---|---|---|
| 1,641,209 | 9/1927 | Wallace | 446/476 |
| 2,110,990 | 3/1938 | Forbes | 446/106 |
| 2,249,060 | 7/1941 | Stone | 446/124 |
| 2,442,122 | 5/1948 | Erhardt | 446/124 X |
| 3,681,888 | 8/1972 | Kim | 446/124 X |
| 4,012,876 | 3/1977 | Grubbs | 52/233 |
| 4,096,674 | 6/1978 | Kollar et al. | 52/233 |
| 4,270,304 | 6/1981 | Sofer | 446/106 |
| 4,372,076 | 2/1983 | Beck | 446/106 |
| 4,412,405 | 11/1983 | Tucker | 52/86 |
| 4,429,500 | 2/1984 | Farmont | 52/233 |
| 4,521,203 | 6/1985 | Rothenberg | 446/106 |
| 4,527,981 | 7/1985 | Chisum | 434/72 |
| 4,585,422 | 4/1986 | Kay | 446/106 |
| 4,708,691 | 11/1987 | Moore | 446/488 |
| 4,740,188 | 4/1988 | Coster | 446/114 |
| 4,909,012 | 3/1990 | Thompson | 52/741 |
| 4,970,839 | 11/1990 | Lavi | 52/311 |
| 4,991,726 | 2/1991 | Johnson | 211/189 |
| 5,036,634 | 8/1991 | Lessard et al. | 52/79.1 |
| 5,145,440 | 9/1992 | Boris et al. | 446/106 |
| 5,174,078 | 12/1992 | West | 52/233 |
| 5,185,982 | 2/1993 | Hostetler | 52/646 |
| 5,281,181 | 1/1994 | McCollum | 446/111 X |
| 5,282,343 | 2/1994 | Stein | 52/233 |
| 5,354,223 | 10/1994 | Wawzonek | 446/106 |
| 5,881,515 | 3/1999 | George | 52/233 |

FOREIGN PATENT DOCUMENTS

| | | | |
|---|---|---|---|
| 543772 | 7/1957 | Canada | 446/124 |
| 988078 | 8/1951 | France | 446/124 |
| 1015385 | 9/1952 | France | 446/124 |
| 3022486 | 1/1981 | Germany | 446/106 |
| 123754 | 12/1927 | Switzerland | 446/106 |
| 641925 | 8/1950 | United Kingdom | 446/124 |

*Primary Examiner*—John A. Ricci
*Attorney, Agent, or Firm*—James R. Stevenson

[57] ABSTRACT

A log assembly set provides an assortment of logs and gable pieces. On opposite sides, each regular log and locking log has notches spaced an end length from each end and a separation length apart from each other. Primarily used to form a base upon which to build a structure, each floor plate log has these notches on one side but is flat on its other side Each locking log has on one side a recess section between each notch. The logs are designed to connect perpendicularly to each other via notch interfacing to form walls wherein the logs lie one longitudinally atop another. Floor boards form flooring between a pair of opposed walls. Each wall can incorporate locking logs such that each locking log disposed in one wall is coplanar with another locking log disposed in the opposite wall. Each floor board can be lockingly retained via the recess sections with each end of the board being retained between the recess-bearing middle section of a locking log and a non-recess-bearing middle section of another log. Each gable piece has flat top edge and a bottom, each bearing notches spaced to connect with the logs. By its bottom, each gable piece connects atop a wall, and may be interconnected to another gable piece by a ridge log spanning their respective top edges at the apex of the roof. A retaining mechanism allows roof boards to retain atop the two sloping sides of the opposed gable pieces to form the roof.

19 Claims, 13 Drawing Sheets

130c

130c

130b

130b

130a

130a

130a

130b

130c
REGULAR LOGS

FLOOR PLATE LOGS 120a
120b
120c

LOCKING LOGS 140a
140b
140c

GABLES

GABLES

750c

750c

750b

750b

750a

750a

750a

750b

750c
RIDGE LOG

FLOOR BOARDS

600c

600b

600a

600c

600c

600b

600b

600a

600a

ROOF BOARDS 700c
700b
700a
700c
700c
700b
700b
700a
700a

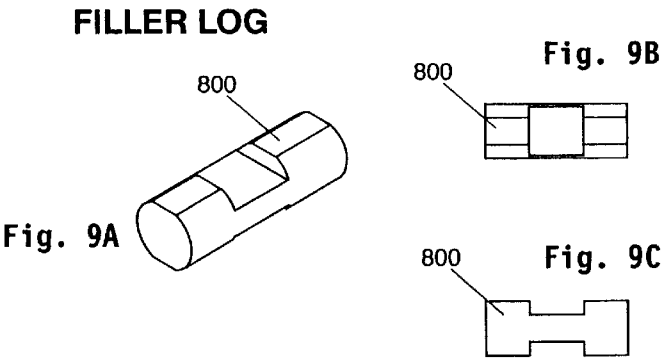
Fig. 9A
Fig. 9B
Fig. 9C
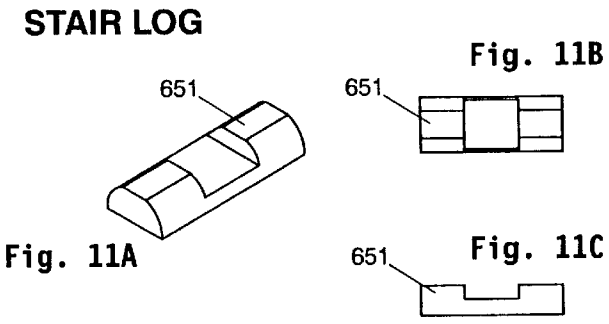
Fig. 11A
Fig. 11B
Fig. 11C
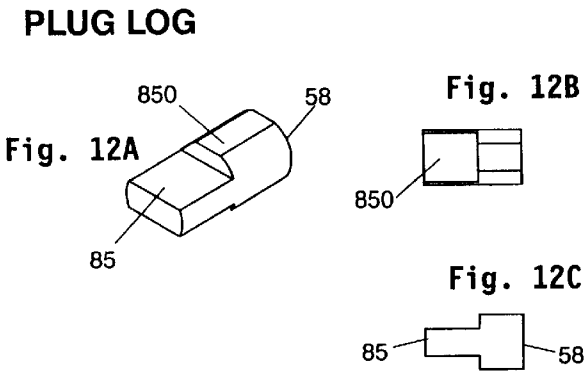
Fig. 12A
Fig. 12B
Fig. 12C

STAIR STRINGER

601c

601c

601b

601b

601a

601a

601a

601b

601c
FLOOR BOARDS

602c

602c

602b

602b

602a

602a

602c

602b

602a
FLOOR BOARDS

LOG BASED ASSEMBLY SET

FIELD OF THE INVENTION

The invention generally relates to toy construction sets of the type that contain interlocking elements and associated components that are marketed collectively in kit form. More particularly, the invention pertains to a log based assembly set, targeted to both the child and adult markets, that comprises locking log members, stir stringers, stair logs and related structural members to which the log members interconnect for erecting a variety of structures of a design limited only by the imagination of the user.

BACKGROUND OF THE INVENTION

Toy construction sets featuring interlocking log elements are well known in the toy industry and related fields and are described in several prior art references. Perhaps the best known of the toy log set genre is the prior art log set marketed under the trademark Lincoln Logs by the Playskool Division of the Hasbro Company of Pawtucket, R.I. The Lincoln Logs™ toy set features a plurality of log elements. Though provided in a variety of lengths, the log elements otherwise share a common shape. It is this common shape that limits the number and types of structures that can be constructed from the Lincoln Logs™ toy set. Moreover, though the Lincoln Logs™ toy set contains certain components for constructing roofs, these components are not designed to interlock compatibly with the log elements. Furthermore, the Lincoln Logs™ toy set is not designed to accommodate flooring.

There are also several other toy construction sets taught in prior art references such as U.S. Patents to Beck U.S. Pat. No. (4,372,076), Wawzonek U.S. Pat. No. (5,354,223), West U.S. Pat. No. (5,174,078) and McCollum U.S. Pat. No. (5,281,181). Beck teaches a modular interlocking block construction toy comprising log pieces of varing lengths and flat pieces for constructing roofs to which the log pieces interconnect. Like the Lincoln Logs™ log elements, however, the log pieces essentially share a common shape. Again, this common shape limits the number and types of features that can be incorporated into structures made from the Beck toy set as compared to the invention set forth infra. Wawzonek discloses a miniature building made of a plurality of wall members interlocked to form walls. The walls mount on a ground floor composed of a series of side by side log members as well as support a roof composed of a series of roof members. The Wawzonek device, however, requires a vertically disposed retaining assembly, in the form of a shaft member, which is used to retain the roof, wall and floor members in position. West teaches a playhouse featuring multiple interlocking planar log-like members and a roof construction having upper and lower tie beams. Roof pieces attach to the tie beams via roof peak pieces disposed on the upper tie beam. McCollum discloses a construction set primarily composed of planar logs and slider elements. The planar logs interlock through notches or notch-bearing mounting plates, and the slider elements, engageable with the planar logs, can be used to construct slidable windows for the structure to be built. The planar log-like members of West, like the planar logs of McCollum, however, feature nothing more than the standardized configuration of recess notches through which the planar log-like members and planar logs, respectively, interconnect. Furthermore, like the other cited prior art, neither West nor McCollum disclose a locking log member or a log based structure that incorporates locking log members as described and claimed infra.

Though primarily designed for children, the invention described and claimed below nevertheless has a degree of complexity that makes it appealing to adults as well. Due to the variety and sophistication of its components, for example, the invention can also be used by architects as a tool to assist in the design of a variety of log based structures. Whether used to construct simple structures typically conceived by young children or ones containing more complex architectural features coveted by adults or hobbyists, the invention should be a welcome addition to the toy construction set market.

The foregoing background information is provided to assist the reader to understand the invention described and claimed below. Accordingly, any terms used herein are not intended to be limited to any particular narrow interpretation unless specifically stated otherwise in this document.

OBJECTIVES OF THE INVENTION

It is, therefore, an objective of the invention to provide a log based assembly set comprising an assortment of components for use in constructing a wide variety of log based structures featuring a variety of architectural features.

Still another objective is to provide a log assembly set featuring a novel locking log member for use in constructing a variety of log based structures.

Even another objective is to permit construction of a variety of log based structures wherein locking log members are used to as a means for supporting and/or locking into place a plurality of flat boards to form flooring.

A further objective is to provide locking log members as a means for supporting and/or locking into place one or more flat boards which can be used to incorporate ceilings, lofts, balconies, porches, shelving and various other similar features into a variety of log based structures.

Yet a further objective is to provide novel stair stringers and accompanying stair logs that interconnect to each other so as to build staircases between levels of a structure.

Still a further objective is to provide filler logs and other auxiliary members that can be used to fashion windows, doorways, and other features so as to provide a finished appearance to whatever type of structure is erected.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the following drawings and claims.

SUMMARY OF THE INVENTION

In a presently preferred embodiment, the invention provides a log based assembly set for erecting a structure. The log assembly set includes pluralities of elongated floor plate logs, regular logs and locking logs. Each of these logs has first and second longitudinally extending sides. Regarding the floor plate logs, the first side defines at least two notches situated symmetrically such that each of the notches is spaced a preset separation length apart by a middle section of the log and one of the notches is spaced a preset end length from each end of the log. The second side is uniformly flat so as to provide a base upon which to build the structure. Regarding the regular and locking logs, the first and second sides each define at least two notches situated symmetrically such that each of the notches on the first side aligns with one of the notches on the second side so as to form at least two pairs of aligned notches in each log. Each pair of notches is spaced the preset separation length apart by a middle section of the log and one of the pairs of notches is spaced the preset end length from each end of the log. Each locking log further defines in its middle section(s) on the first side a flat recess section. The aforementioned logs connect at right angles to each other via mutual interfacing of the notches so as to construct walls wherein the logs lie generally longitudinally one atop another. The log assembly set also includes a plurality of gable pieces for forming a roof. Each gable piece has a triangular shape with a flat top edge, a flat bottom, and two equal flat sloping sides at an acute angle to the bottom and an obtuse angle to the top edge. The top edge defines one notch situated symmetrically along its length. The bottom defines at least two notches situated symmetrically such that each of the notches is spaced the preset separation length apart by a middle section and one of the notches is spaced the preset end length from each end of the bottom. The notches of each gable piece are thus spaced for connection with the notches of the aforementioned logs. Connected by its bottom to logs atop the wall(s), each gable piece may be disposed opposite another similarly disposed gable piece, with the top edges of the opposed gable pieces preferably interconnected by one of the aforementioned logs at an apex of the roof. The log assembly set also preferably includes a plurality of floor boards and a plurality of roof boards. The floor boards are used to construct flooring between a pair of opposed walls. Each of the opposed walls can incorporate locking logs such that each locking log disposed in one wall is coplanar with another locking log disposed in the opposite wall. Each of the floor boards is of a preset dimension in height matched to fit within the flat recess sections of the locking logs. This allows the respective ends of each floor board to retain Mockingly in the opposing walls within the flat recess sections of the locking logs. Primarily used to construct the roof, each roof board lays flat atop the sloping sides of the opposed gable pieces. The assembly set further includes a means for retaining the roof boards upon the sloped sides of the opposed gable pieces.

BRIEF DESCRIPTION OF THE DRAWINGS

FIGS. 9A–9C provide perspective, top and side views of the filler logs according to the invention.

FIGS. 11A–11C provide perspective, top and side views of the stair logs according to the invention.

FIGS. 12A–12C provide perspective, top and side views of the plug logs according to the invention.

DETAILED DESCRIPTION OF THE INVENTION

Figure 1:
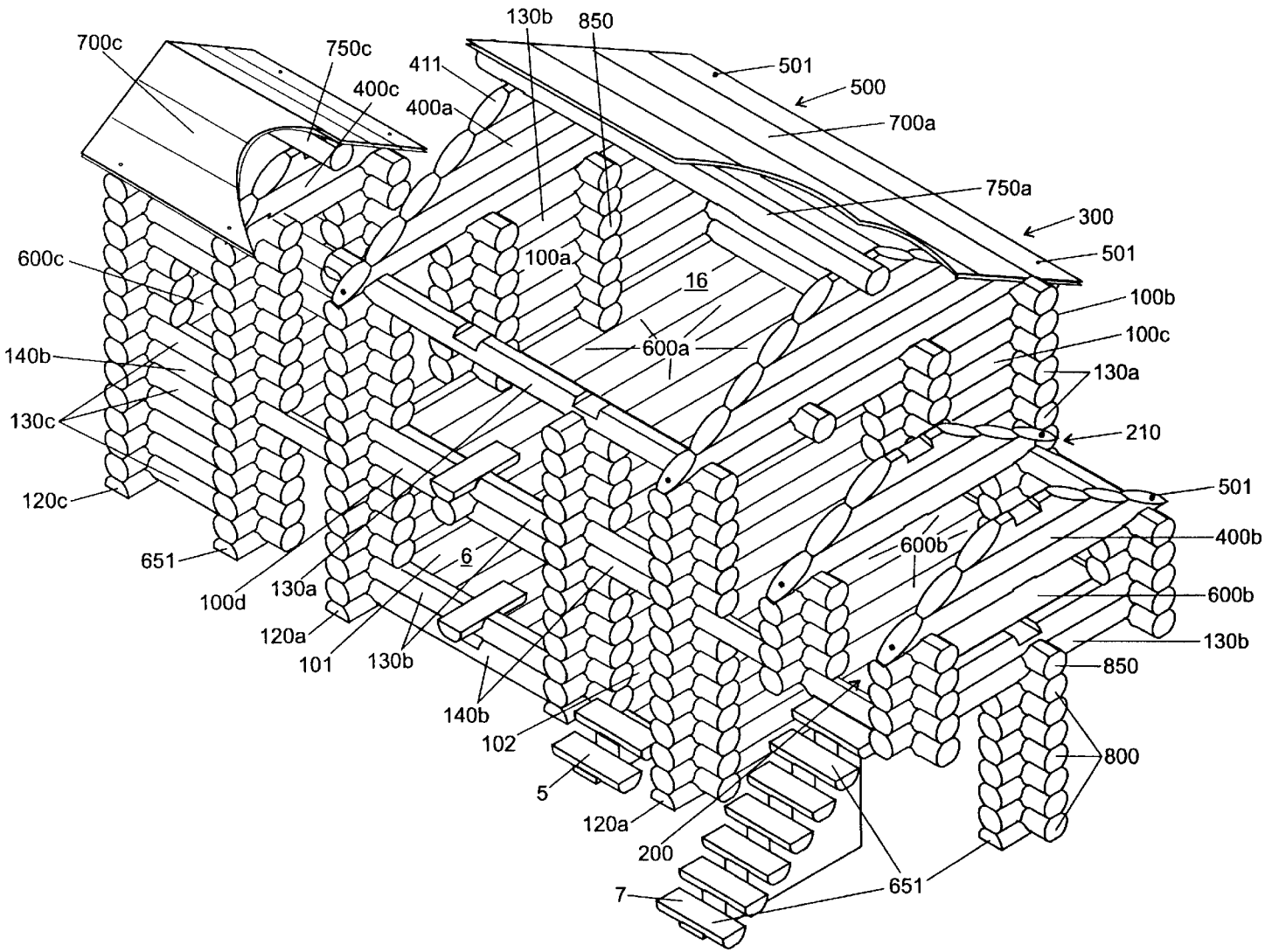
FIG. 1 is a perspective view, partly in exploded form, of a representative structure constructed from the log based assembly set according to the invention.
Figures 2A, 2B, 2C, 2D, 2E, 2F, 2G, 2H, 2I:
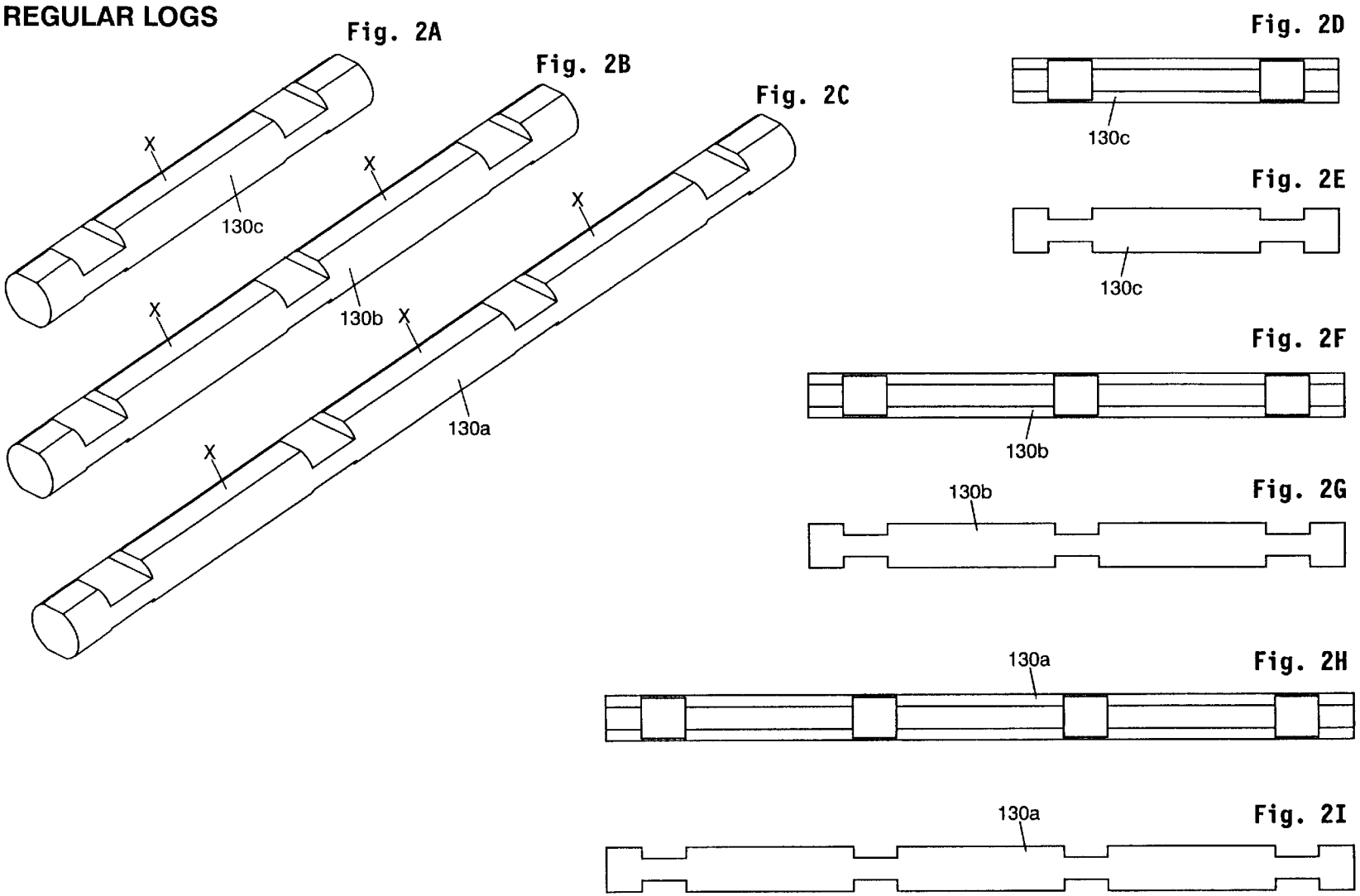
FIGS. 2A–2I provide perspective, top and side views of the regular logs according to the invention.
Figures 3A, 3B, 3C, 3D, 3E, 3F, 3G, 3H, 3I:
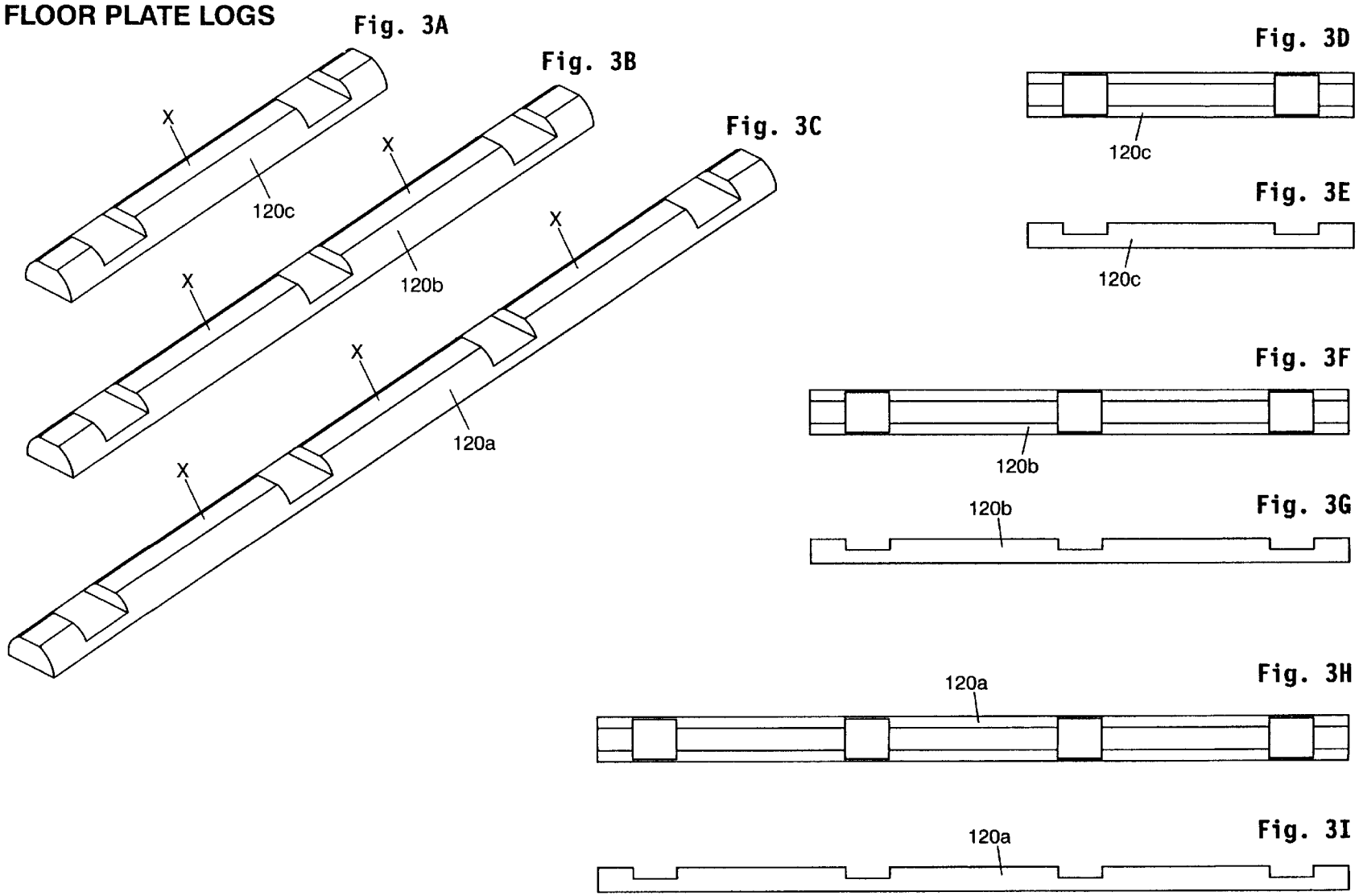
FIGS. 3A—3I provide perspective, top and side views of the floor plate logs according to the invention.
Figures 4A, 4B, 4C, 4D, 4E, 4F, 4G, 4H, 4I:
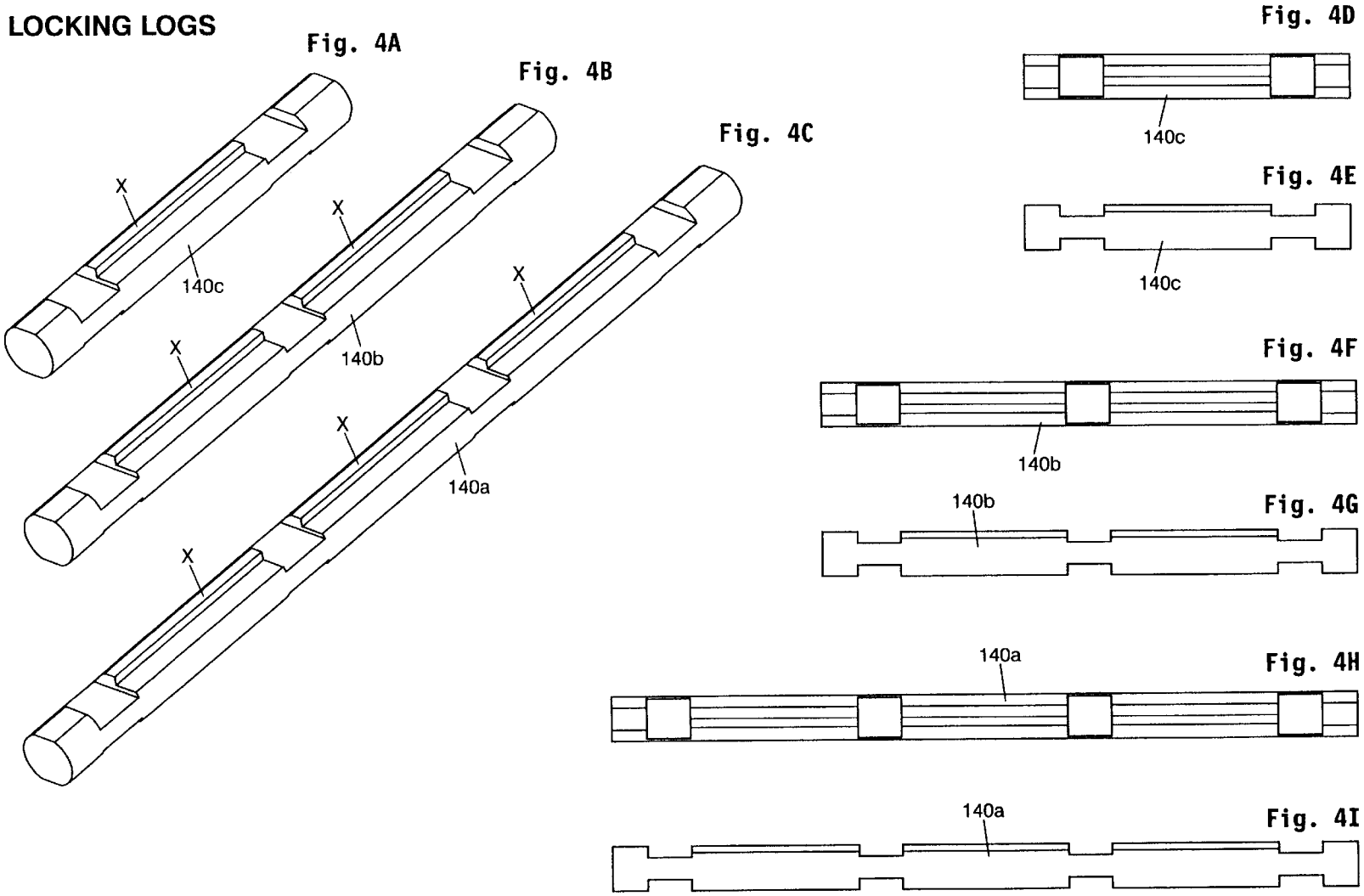
FIGS. 4A–4I provide perspective, top and side views of the locking logs according to the invention.

Before describing the invention in detail, the reader is advised that, for the sake of clarity and understanding, identical components having identical functions have been marked where possible with the same reference numerals in each of the Figures provided in this document.

FIGS. 1 through 14I illustrate the essential details of a presently preferred embodiment of the invention. The log based assembly set of the invention comprises a set of improved log members and related structural members to which the log members interconnect for constructing a variety of structures of a design limited only by the imagination of the user. The majority of the components bear notches through which the log members and related structural members interconnect to form structures such as the representative structure illustrated in FIG. 1. The representative structure 1 comprises a small, substantially completed cabin, which is simple in comparison to the elaborate structures capable of being constructed from this log assembly set. Although simple in construction, the cabin 1 demonstrates how the components of the invention may be used conventionally and also how they may be assembled without need for adhesives, nails, screws or various other fastening means.

The log assembly set includes a plurality of elongated logs inclusive of floor plate logs 120, regular logs 130 and locking logs 140. The regular logs 130 and locking logs 140 are primarily used to construct walls whereas floor plate logs 120 are chiefly used to provide a base upon which the structure may be built. The invention also includes a plurality of gable pieces 400 and a plurality of flat boards inclusive of floor boards 600 and roof boards 700. Several pluralities of auxiliary components such as filler logs 800, plug logs 850, stair stringers 650 and stair logs 651 may be used to incorporate various features into the desired structure.

Referring to FIG. 1, the representative structure 1 has a first pair of opposing walls 100*a* and 100*c* and a second pair of opposing walls 100*b* and 100*d*. Walls 100*a* and 100*d*, for example, are each constructed from a combination of logs of various lengths as described in greater detail below. This permits wall 100*d* to feature a window 101 and a doorway 102. Wall 100*c* opens upon an entranceway 200 with an overhanging roofed balcony, generally designated 210. Floor boards 600*b* laid flat adjacently to each other serve as the floor for balcony 210. Roof boards 700*a* laid flat adjacently to each other across the pair of opposed gables 400*a* serve to form a roof 300. The roof boards are retained in place on the respective sloping sides 411 of the gables 400*a* via a retaining means, generally designated 500. At the apex of roof 300, the cabin 1 is capped by a ridge log 750*a* that interconnects the top edges 415 of the opposed gable pieces 400*a*. The representative structure 1 also has a main floor 6 constructed of floor boards 600*a* laid flat adjacently to each other whose ends are lockingly retained between locking logs 140*b* and regular logs 130*b* disposed in each of opposed walls 100*b* and 100*d*. Staircases 5 and 7 span between ground level and main floor 6 and ground level and the floor of balcony 210, respectively.

FIGS. 2 through 14I illustrate each of the components of the log based assembly set. These figures also further assist the description of the representative cabin of FIG. 1. It should be understood that the log assembly set typically will contain a plurality of each component illustrated in those figures, preferably in the quantities listed in Table I.

The floor plate logs 120, regular logs 130 and locking logs 140 used in the construction of the representative structure of FIG. 1 are of three different lengths: long, medium, and short. Preferably, the measures for the three different lengths are approximately 21.25 inches for the long length, 15.25 inches for the medium length, and 9.25 inches for the short length. Each of these logs is provided with multiple notches of standardized dimension to permit the logs to interlock perpendicularly via mutual interfacing of the notches. Each of the notches is preferably rectangular in shape and extends widthwise completely through the member. Preferably, each notch is approximately 1.25 inches in length and measures 0.3125 inches in depth; the preset notch length and the preset notch depth, respectively. The notches in each of these logs are spaced approximately a preset separation length (preferably 4.75 inches) apart with the notch closest to each end spaced approximately a preset end length (preferably 1 inch) from each respective end. The preset length and depth measurements form the basis upon which the invention is derived. Accordingly, other notch bearing components of the invention abide by these preset measurements as explained more fully below.

TABLE I

TYPICAL COMPONENTS IN PREFERRED EMBODIMENT

| Component | Reference Number | Quantity |
|---|---|---|
| Floor Plate logs - long | 120a | 8 |
| Floor Plate logs - medium | 120b | 8 |
| Floor Plate logs - short | 120c | 8 |
| Regular logs - long | 130a | 52 |
| Regular logs - medium | 130b | 52 |
| Regular logs - short | 130c | 50 |
| Locking logs - long | 140a | 8 |
| Locking logs - medium | 140b | 8 |
| Locking logs - short | 140c | 8 |
| Gable pieces - long | 400a | 2 |
| Gable pieces - medium | 400b | 2 |
| Gable pieces - short | 400c | 2 |
| Floor boards - long | 600a | 20 |
| Floor boards - medium | 600b | 20 |
| Floor boards - short | 600c | 18 |
| Stair stringers - second | 650a | 1 |
| Stair stringers - first | 650c | 1 |
| Stair logs | 651 | 20 |
| Roof boards - long | 700a | 26 |
| Roof boards - medium | 700b | 20 |
| Roof boards - short | 700c | 20 |
| Ridge logs - long | 750a | 2 |
| Ridge logs - medium | 750b | 2 |
| Ridge logs - short | 750c | 2 |
| Filler logs | 800 | 180 |
| Plug logs | 850 | 100 |
| Floor filler boards - long | 601a | 4 |
| Floor filler boards - medium | 601b | 4 |
| Floor filler boards - short (0.625" wide) | 601c | 4 |
| Floor filler boards - long | 602a | 4 |
| Floor filler boards - medium | 602b | 4 |
| Floor filler boards - short (0.1875" wide) | 602c | 4 |

The various types of logs provided with the log based assembly set will now be presented separately and the unique characteristics of each will also be discussed. Regarding the regular logs 130 illustrated in FIGS. 2A–2I, each log has first and second longitudinally extending flat sides. The first and second sides each bear at least two notches situated symmetrically such that each notch on the first side directly aligns with a notch on the second side so as to form at least two pairs of aligned notches in each log. The notch pairs are spaced the preset separation length apart with the notch pair closest to each end spaced the preset end length from each respective end. Regarding the size of the regular logs, the long logs 130*a* have four pairs of aligned notches, each pair being spaced the preset separation length apart by a middle section X with the endmost notch pairs each being spaced the preset end length from one of the ends. The medium logs 130*b* have three pairs of aligned notches, each pair being spaced the preset separation length apart by middle section X. The middle pair of notches is centered equidistant from each end of log 130*b*. Each of the two end pairs of notches, of course, is each spaced the preset end length from one end of log 130*b*. The short logs 130*c* have two pairs of aligned notches, each pair being spaced the preset separation length apart by middle section X and the preset end length from one end of log 130*c*. Viewed cross-sectionally, each regular log 130 is generally slightly oval in shape, with preferably 1.25 inches in height between the opposing sides. The preset notch depth is thus approximately one quarter of the height of each regular log 130 so as to allow contiguous longitudinal stacking of the logs contained in the walls 100 of the representative structure 1.

Regarding the floor plate logs 120 illustrated in FIGS. 3A–3I, each log 120 has first and second longitudinally extending flat sides. As for the first side of each floor plate log, the long, medium and short floor plate logs 120*a*, 120*b* and 120*c*, respectively feature the same notch dimensions and spacing as described for the regular logs 130*a*, 130*b* and 130*c*. Unlike the regular logs, however, the second side of each floor plate log is uniformly flat, and therefore does not feature any notches. This makes the floor plate logs 120 especially useful in forming a base upon which a structure such as cabin 1 can be built. Regarding size, the long, medium and short floor plate logs 120*a*, 120*b* and 120*c*, respectively have the same length as described for the regular logs 130*a*, 130*b* and 130*c*. Viewed cross-sectionally, each floor plate log 120 is generally semi-oval in shape, with preferably 0.625 inches in height between the opposing sides so that any of the notch bearing components of the invention can interlock flushly with respect to the second side of each floor plate log 120.

Regarding the locking logs 140 shown in FIGS. 4A–4I, each log 140 has first and second longitudinally extending flat sides. As for notch dimensions and spacing, the long, medium and short locking logs 140*a*, 140*b* and 140*c*, respectively feature the same notch dimensions and spacing as described for the first and second sides of regular logs 130*a*, 130*b* and 130*c*. The long, medium and short locking logs also respectively have the same length as their regular log counterparts. Unlike the regular logs, however, each locking log further defines a flat recess section Y in each of the middle sections X on the first side. Preferably having a depth of 0.1875 inches, the flat recess sections are used to retain the floor boards as described in greater detail below. Viewed cross-sectionally, each locking log 140 is generally slightly oval in shape, with preferably 1.25 inches in height between the opposing sides, notwithstanding the notches and flat recess sections.

Referring now to FIGS. 5A–5J, the gable pieces 400 are primarily used in the construction of roofs such as the one covering the representative structure 1 of FIG. 1. Each of the gable pieces 400 has a generally triangular shape with a flat top edge 415, a flat bottom 425, and two equal flat sloping sides 411 at an acute angle to the bottom and an obtuse angle to the top edge. The top edge 415 bears one notch centered along its length. The bottom 425 bears at least two notches situated symmetrically such that each notch is spaced the preset separation length apart with the notch closest to each end spaced the preset end length from its respective end. The notches of the bottom are thus spaced for connection with the notches of the aforementioned logs. For example, in the representative structure 1 of FIG. 1, one gable piece 400*a* is connected by its bottom to the logs atop one of the opposing walls 100*a*. An opposing gable piece 400*a* is likewise connected atop the other opposing wall 100*c*. The top edges of each of the opposed gable pieces 400*a* are interconnected with one of the logs, preferably a ridge log 750*a*, at the apex of roof 300. Alternately, the roof boards 700 described below may be laid flat adjacently to each other atop the opposed top edges of the pair of opposed gable pieces 400*a*.

Figures 5A, 5B, 5C, 5D:
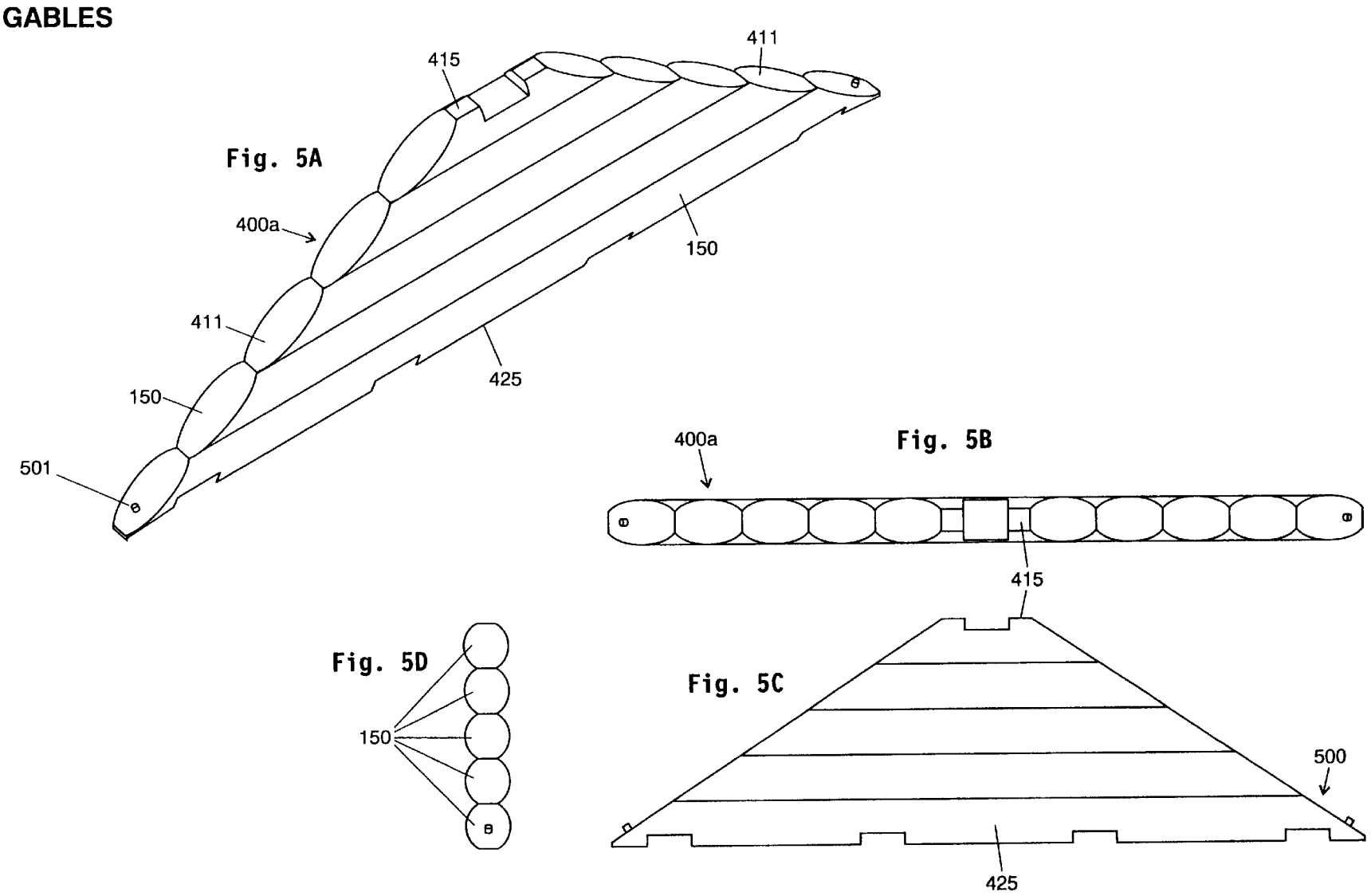
FIGS. 5A–5D provide perspective, top, side and end views of the long gable according to the invention.
Figure 5F:
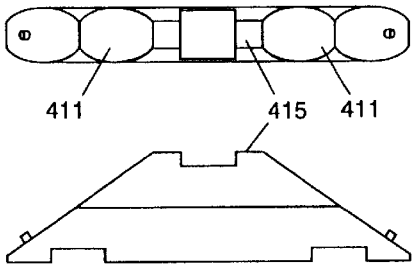
FIGS. 5E–5J provide perspective, top and side views of the medium and short gables according to the invention.
Figure 5G:
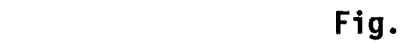
Figure 5I:
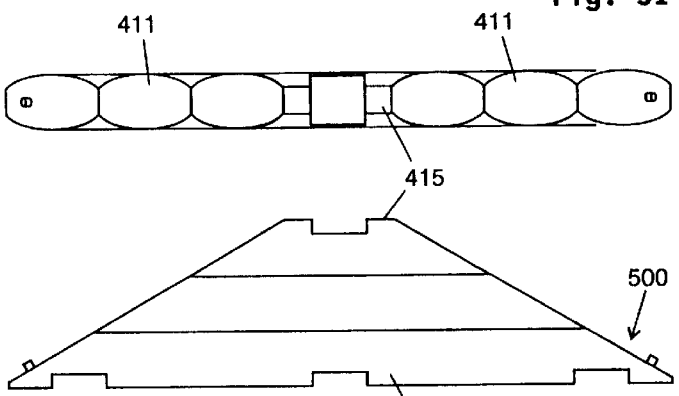
Figure 5J:
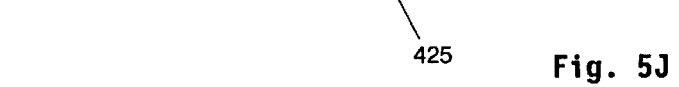
Figure 5E:
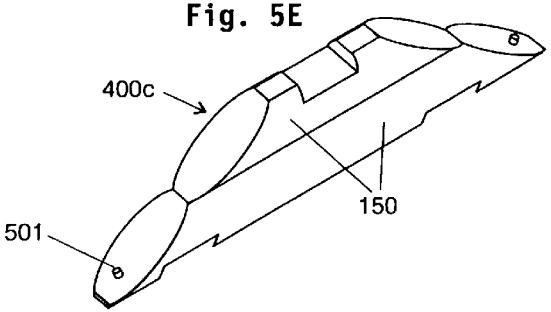
Figure 5H:
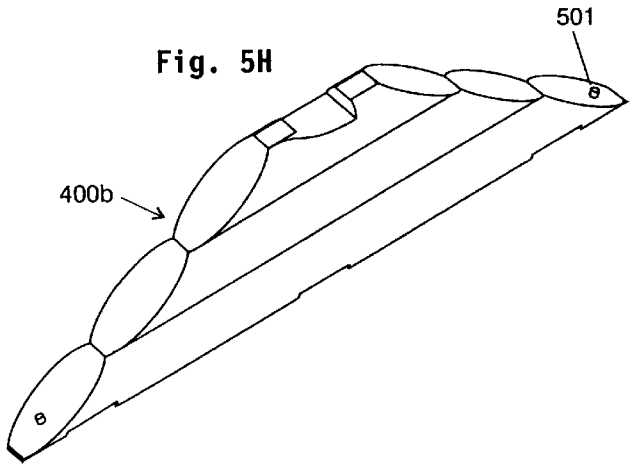
Figures 6A, 6B, 6C, 6D, 6E, 6F, 6G, 6H, 6I:
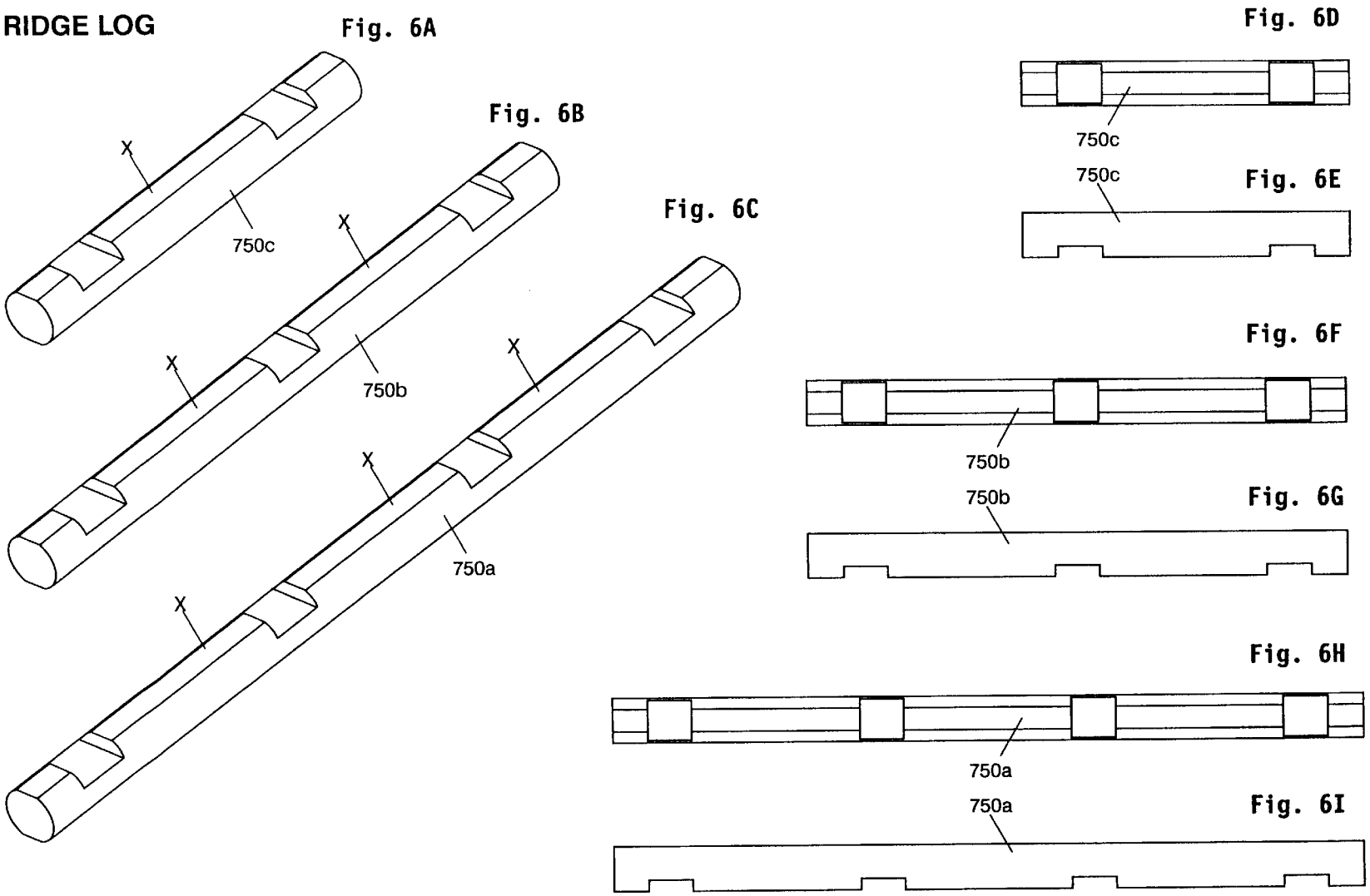
FIGS. 6A–6I provide perspective, top and side views of the ridge logs according to the invention.
Figures 7A, 7B, 7C, 7D, 7E, 7F, 7G, 7H, 7I:
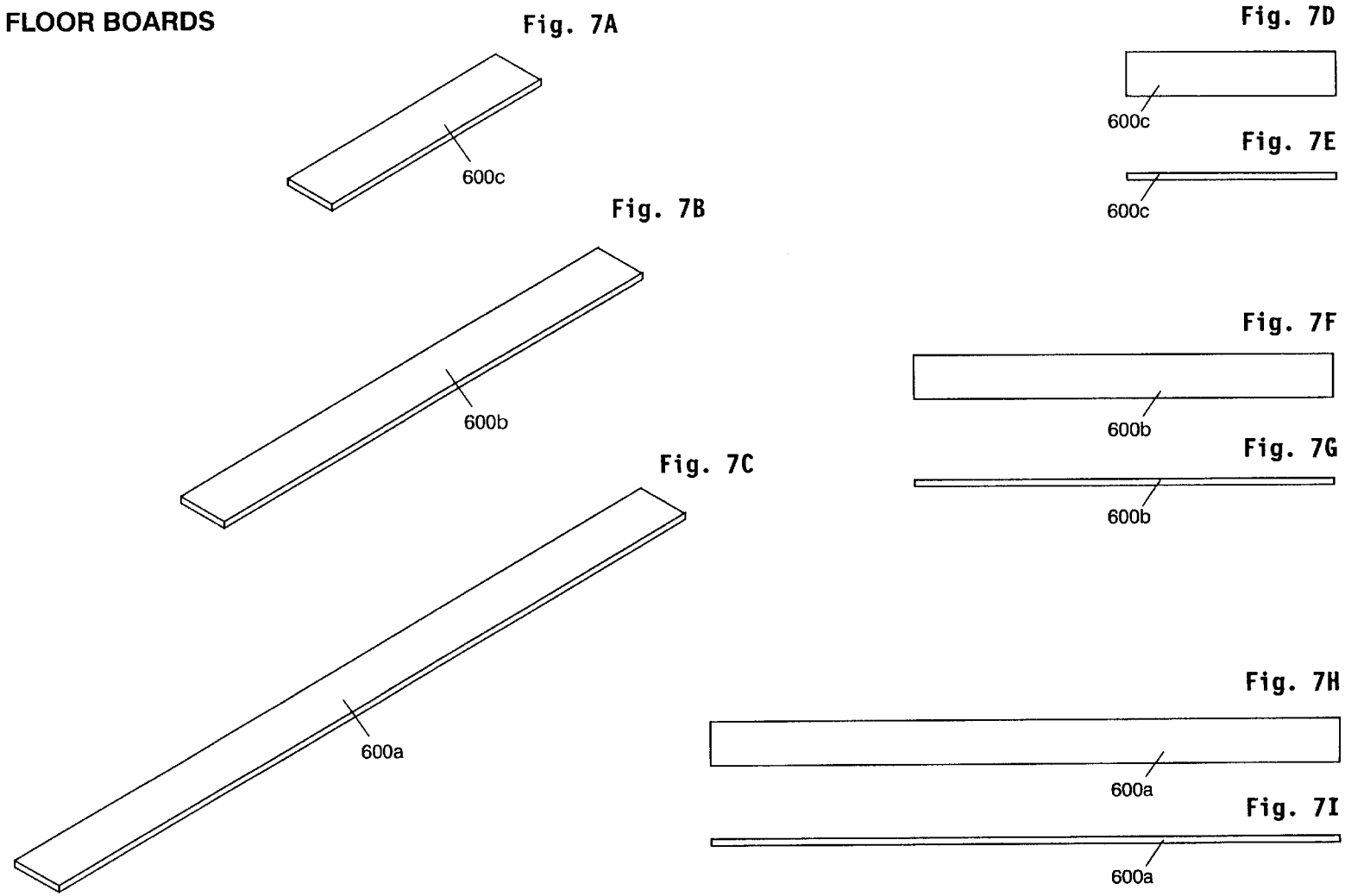
FIGS. 7A–7I provide perspective, top and side views of the floor boards according to the invention.
Figures 8A, 8B, 8C, 8D, 8E, 8F, 8G, 8H, 8I:
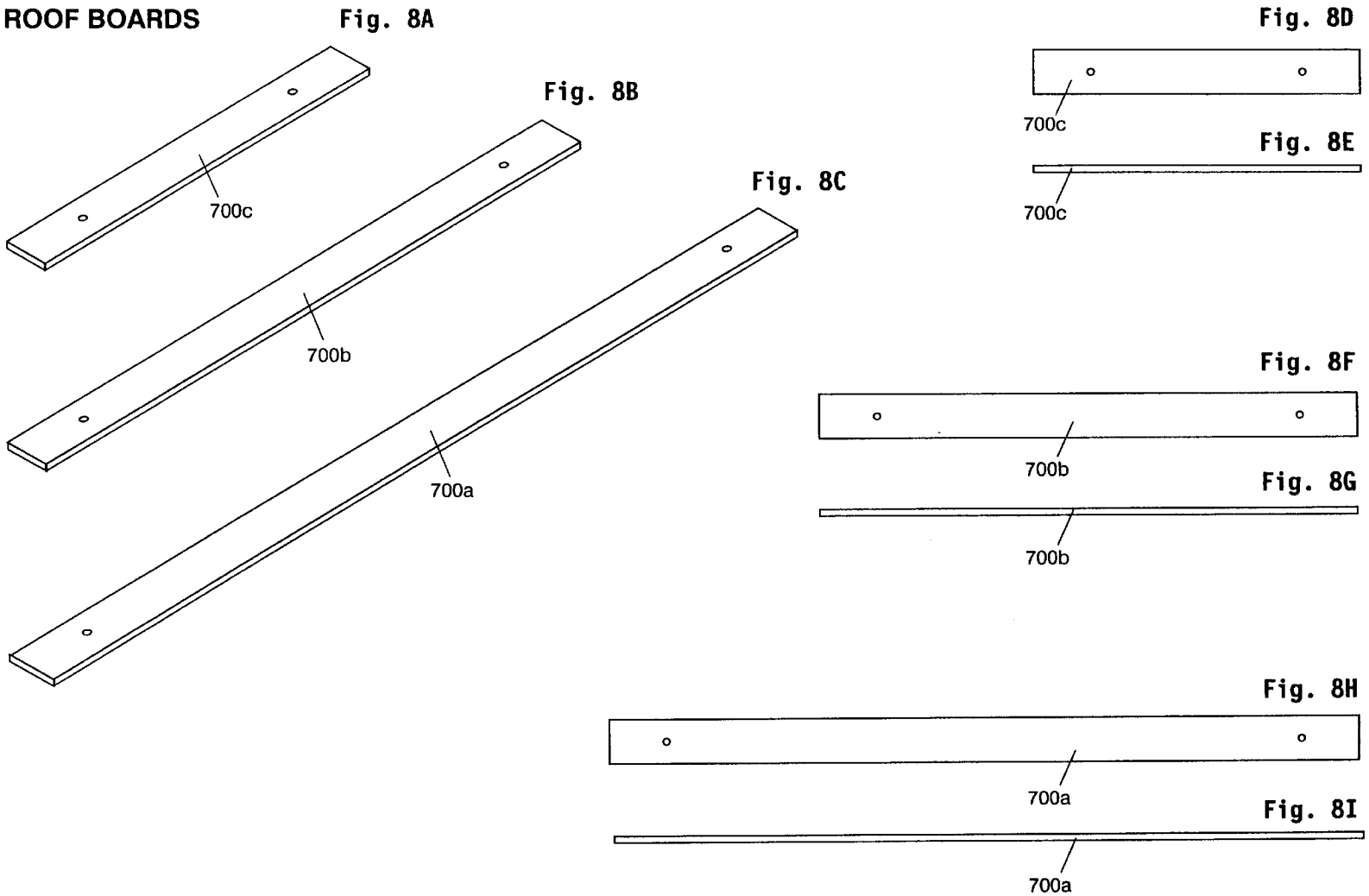
FIGS. 8A–8I provide perspective, top and side views of the roof boards according to the invention.
Figure 10D:
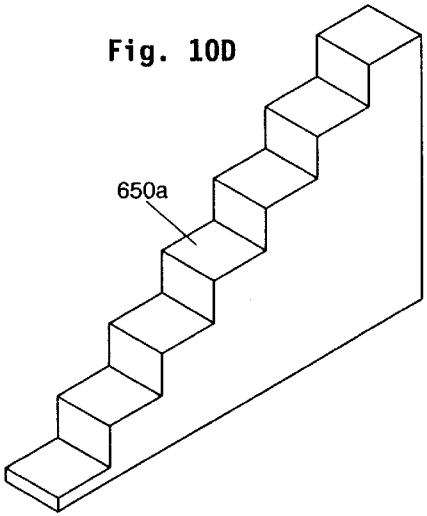
FIGS. 10A–10F provide perspective, top and side views of the stair stringers according to the invention.
Figure 10E:
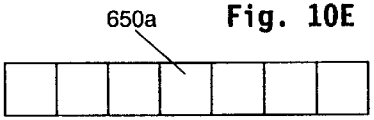
Figure 10F:
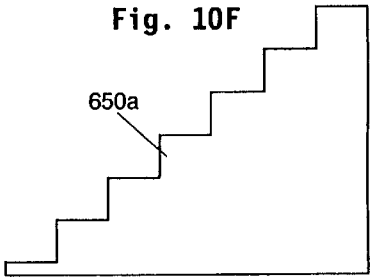
Figure 10B:
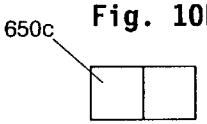
Figure 10C:
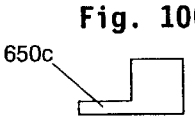
Figure 10A:
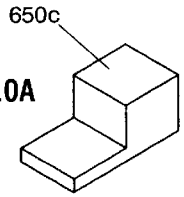
Figures 13A, 13B, 13C, 13D, 13E, 13F, 13G, 13H, 13I:
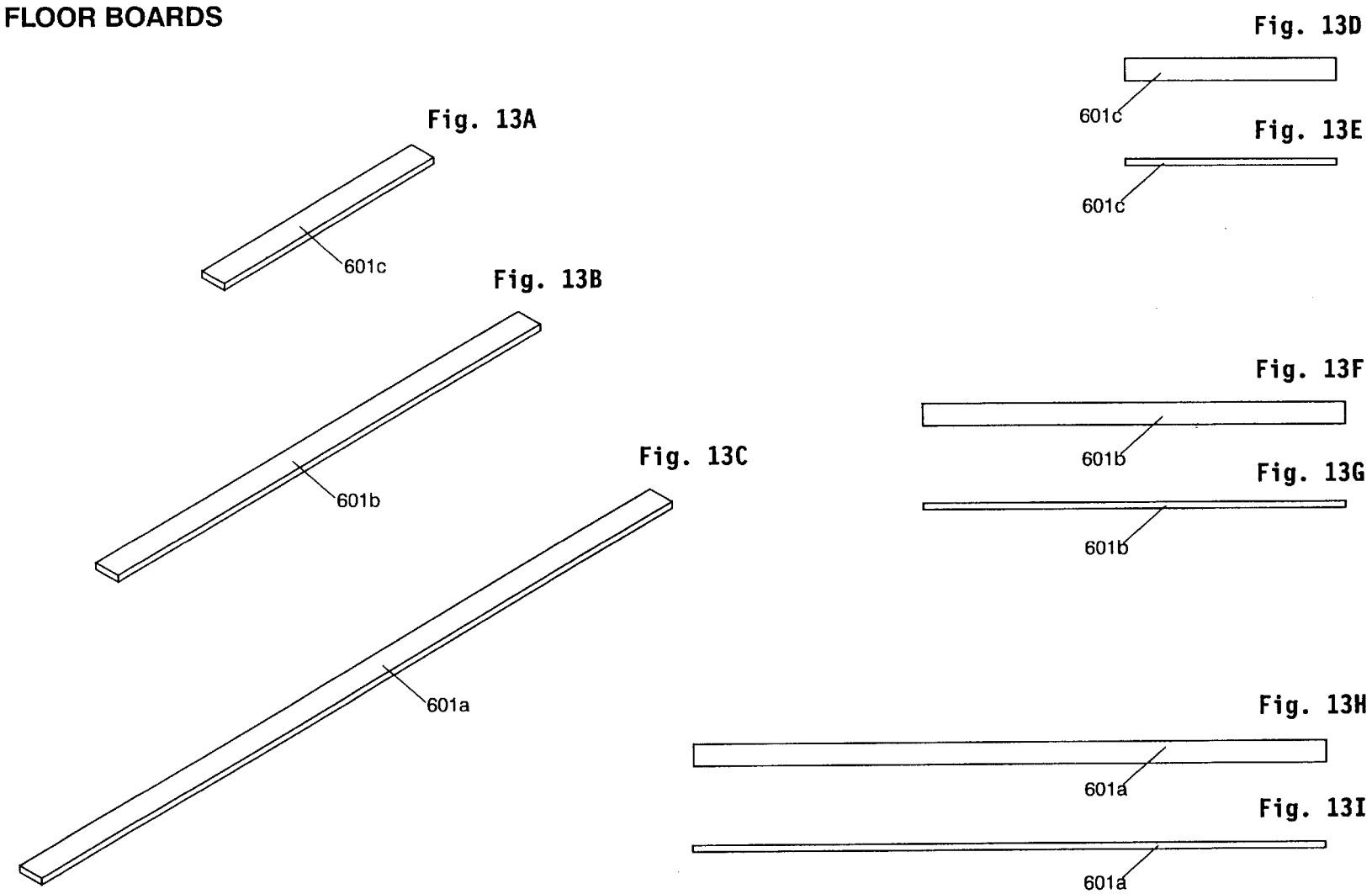
FIGS. 13A–13I provide perspective, top and side views of the floor filler boards according to the invention.
Figures 14A, 14B, 14C, 14D, 14E, 14F, 14G, 14H, 14I:
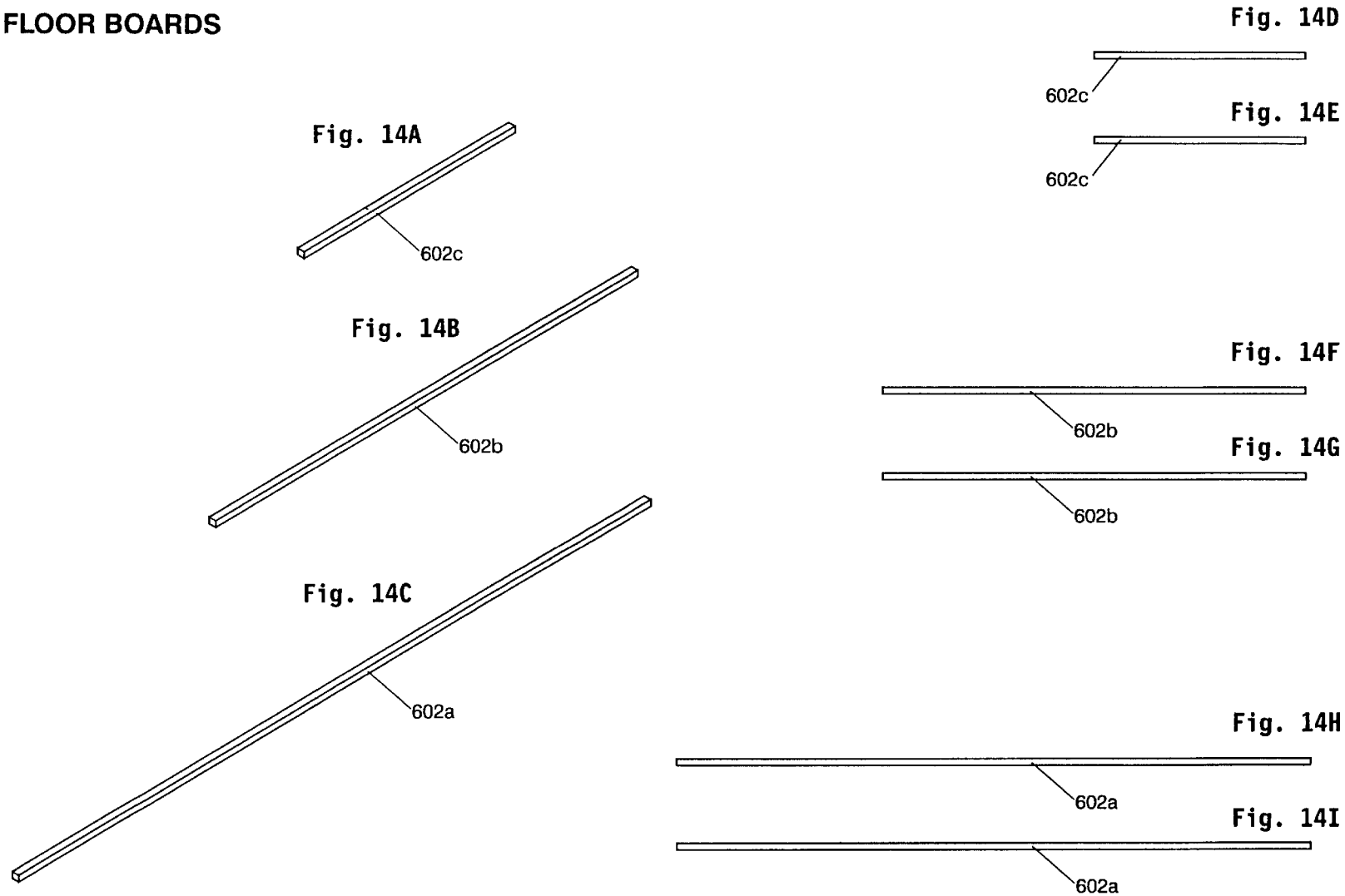
FIGS. 14A–14I provide perspective, top and side views of other floor filler boards according to the invention.

The gable pieces 400 come in three different sizes. The difference in size, however, derives primarily from the length of the bottom 425 of each gable piece. Specifically, as shown in FIGS. 5A–5D, each long gable piece 400*a* has four notches on its bottom, the notch dimensions and spacing being the same as that described for all of the aforementioned long logs. Referring now to FIGS. 5H–5J, each medium gable piece 400*b* has three notches on its bottom, the notch dimensions and spacing being the same as that described for all of the aforementioned medium logs. Each short gable piece 400*c* has two notches on its bottoma, shown in FIGS. 5E–5G, the notch dimensions and spacing matching that described for all of the aforementioned short logs. The gable pieces 400 through the length of, and the spacing of the notches on, their bottoms are designed to be interlocked perpendicularly to the logs via mutual interfacing of the notches. The different lengths for the bottoms are therefore 21.25 inches for the long length, 15.25 inches for the medium length, and 9.25 inches for the short length gable pieces.

Each of the gable pieces 400 is preferably formed from at least two angle-ended logs stacked longitudinally one atop another. Each angle-ended log 150 has first and second longitudinally extending flat sides. The ends of each angle-ended log form an acute angle to the second side and an obtuse angle to the first side. The angle-ended logs of each gable piece stack longitudinally such that the second side of one angle-ended log has a length equal to and stacks longitudinally atop the first side of another angle-ended log. When the angle-ended logs are stacked longitudinally, the angled ends of each log are aligned flushly at the respective ends so as to form the flat sloping sides of the gable piece. The first side of a topmost angle-ended log of a gable piece constitutes the flat top edge of the gable piece. The second side of a bottommost angle-ended log constitutes the flat bottom of the gable piece. Viewed cross-sectionally, each angle-ended log 150 is generally slightly oval in shape with preferably 1.25 inches in height between the opposing sides.

As explained previously, the gable pieces 400 come in three different sizes. The short gable pieces 400*c* are each preferably made of two angle-ended logs stacked longitudinally one atop another, as shown in FIGS. 5E–5G. The height of each short gable piece 400*c* is therefore approximately 2.50 inches between the top and bottom edges. The medium gable pieces 400*b* are each preferably made of three angle-ended logs stacked longitudinally one atop another and have a height of approximately 3.75 inches. As shown in FIGS. 5A–5D, the long gable pieces 400*a* are each preferably made of five angle-ended logs and have a height of approximately 6.25 inches.

Primarily for aesthetic reasons, the length of the flat top edge is preferably identical for each of the gable pieces 400. A flat top edge length of 2.25 inches is preferred. This leaves an end section one half inch long on either side of the centrally disposed notch. Given that the length of the top edge is preferably fixed and that the bottom may be any one of three different lengths depending on the particular gable piece at issue, the acute and obtuse angles will vary depending upon which of the long, medium or short gable pieces is considered. Regardless which of the bottom lengths is considered, gable pieces 400 having a top edge of the recommended length have been determined to provide an aesthetically pleasing triangular configuration and are well suited for building roofs such as the one covering the representative cabin 1 illustrated in FIG. 1.

Regarding the ridge logs illustrated in FIGS. 6A–6I, each ridge log 750 has first and second longitudinally extending flat sides. As for the first side of each ridge log, the long, medium and short ridge logs 750*a*, 750*b* and 750*c*, respectively feature the same notch dimensions and spacing as described for the regular logs 130*a*, 130*b* and 130*c*. The long, medium and short ridge logs also respectively have the same length as their regular log counterparts. Unlike the regular logs, the second side of each ridge log does not contain any notches. This makes the ridge logs 750 especially useful in interconnecting the notches within the top edges of opposed gable pieces 400*a* at the apex of roof 300, as shown in FIG. 1. Alternately, the ridge logs could be used like the floor plate logs 120 in forming the base upon which a structure such as cabin 1 can be built. Viewed cross-sectionally, each ridge log 750 is generally slightly oval in shape with preferably 1.25 inches in height between the opposing sides.

Referring now to FIGS. 7A–7I, the floor boards 600 are primarily used in the construction of floors, balconies, lofts, shelves, terraces or like elevated features such as the main floor 6, the second floor 16 and the floor of balcony 210 featured in the representative cabin 1 of FIG. 1. The floor boards 600 are generally used to construct flooring between a pair of opposed walls. For each level on which flooring is desired, each of the opposed walls has disposed within it one locking log such that the two opposing locking logs are disposed coplanarly. Each of the floor boards 600 has as a height (i.e., as a thickness) a preset dimension matched to fit within the depth of each of the flat recess sections of the locking logs. In addition, the floor boards 600 are each of a preferred width equal to the preset separation length divided by an integer so that an integer number of floor boards laid flat adjacently to each other match the preset separation length. Alternately, the width of each floor board 600 may equal the preset separation length. The ends of the floor boards 600 are intended to retain lockingly within the flat recess sections of the two opposing locking logs in the opposing walls. Specifically, any given floor board at each end may be sandwiched between the middle section defining the flat recess section of a locking log 140 and any of the middle sections of (i) the first and second sides of the regular logs 130, (ii) the second sides of other locking logs 140 and (iii) the bottoms of the gable pieces 400.

The floor boards, like the elongated logs, come in three different lengths. Preferably, the length of the long, medium and short floor boards 600*a*, 600*b* and 600*c* are approximately the length of their regular log counterparts minus about thrice the preset end length. The floor boards selected to construct any given floor are thus shorter by about thrice the preset end length than the logs primarily making up one of the walls to which the opposing walls are connected perpendicularly. The reason for the shorter length is to assure that the floor boards 600 fit between the opposing walls that carry the coplanarly disposed locking logs 140.

From the foregoing, it should be apparent that the flat recess section of each locking log 140 may take any one of two forms. In the first form as illustrated in FIGS. 4A–4I, the flat recess section extends only partly widthwise into the locking log. In the second form (not shown), the flat recess section extends widthwise completely through locking log. In opposing walls constructed with the first form of locking logs, care must be taken so as to position the locking logs within the opposing walls so that the flat recess sections face each other, otherwise the ends of the floor boards could not be secured within both of the opposing walls. In opposing walls constructed with the second form of locking logs, such precise positioning of the locking logs is not an issue. It should be noted that walls incorporating locking logs of the first form have been determined to provide a more aesthetically pleasing appearance exteriorly than walls bearing locking logs of the second form. When viewed exteriorly, the latter walls do not conceal from view the ends of the floor boards 600 locked within the opposing walls.

There are, however, certain advantages in using locking logs of the second form within opposing walls. One advantage is that the floor boards 600 may be inserted into the flat recess sections after the opposing walls have been constructed. Flooring can thus be added to a structure after the walls have been assembled. Removal of the floor boards 600 without disassembling the opposing walls is also accomplished easily. Another advantage is that flat boards longer than the floor boards may also be used to construct flooring but with the excess length extending exteriorly (i.e., cantilevered) from one or both of the opposed walls. This extension can serve whatever purpose the builder desires such as a shelter for an imaginary carport or a diving platform for an imaginary swimming pool.

Referring to FIGS. 8A–8I, the roof boards 700, like the elongated logs, come in three different lengths. Preferably, the length of the long, medium and short roof boards 700*a*, 700*b* and 700*c* are approximately the length of their regular log counterparts. Near each of its ends, each roof board may also define an orifice disposed along its centerline, for the reasons explained below. The roof boards selected to span across and cover the sloping sides of any pair of opposed gable pieces are thus about equal in length to the logs used to interconnect the opposed gable pieces. The reason for the such length is to allow the roof boards 700 to decoratively overhang each of the opposed gable pieces so as to provide an aesthetically pleasing roof such as the one atop the representative cabin of FIG. 1.

The log based assembly set also includes a means for retaining the roof boards upon the sloped sides of the gable pieces. Best illustrated in FIGS. 1 and 5A–5J, this retaining means 500 may take the form of an adhesive such as ordinary glue. Preferably, though, means 500 includes a locking peg 501 secured within an aperture defined within each sloping side approximate the vertex of the acute angle. Each aperture is preferably oriented perpendicularly within its corresponding sloping side and has a dimension that permits snug fitting of the locking peg 501. Disposed within the aperture, the locking peg 501 prevents the roof boards from sliding off the sloping sides of the gable pieces either by fitting in the orifices of the last roof board or by serving merely as an abutment. The preferred retaining means 500 is preferably incorporated into each of the gable pieces 400 of the log assembly set as sold.

The log assembly set also includes a plurality of filler logs 800 as shown in FIGS. 9A–9C. Essentially a miniature regular log, each filler log has first and second longitudinally extending flat sides. The two sides each bear one notch centered equidistantly from each end of the filler log. Consequently, the notch on the first side directly aligns with the notch on the second side so as to form a pair of aligned notches in each filler log. Viewed cross-sectionally, each filler log 800 is generally slightly oval in shape, with preferably 1.25 inches in height between the opposite sides.

The filler logs 800 may be used to add a wide variety of features to a structure such as window 101 and doorway 102 of the representative cabin 1 shown in FIG. 1. The filler logs may be incorporated into a structure so as to create openings of various sizes and shapes within the walls of a structure. The openings may serve as windows or doorways, as noted, or even as gunslits for forts. The filler logs 800 in conjunction with the other logs to which they interlock serve essentially to form the headers, transoms, thresholds, stiles and sills of doors and windows. The filler logs 800 may also be used to construct the pillars for the overhanging roofed balcony 210 or various other features a builder may desire.

The log assembly set also includes a plurality of stair stringers 650 each of which can be used as a staircase preferably in conjunction with stair logs 651. Stair stringers of two different sizes will preferably be provided in each set, as shown in FIGS. 1 and 10A–10F. Each stair stringer is designed to link two levels. The first stair stringer 650*c* is preferably used as a staircase between a ground level and a lowest floor or like landing approximately 2.5 inches apart vertically. This measurement represents the sum of the vertical heights of one regular log (1.25" at a middle section), one locking log (1.0625" at a recess section) and one floor board (0.1875") laid atop the recess section of the locking log. The second stair stringer 650*a* is preferably used as a staircase between floors disposed approximately 7.5 inches apart. This measurement represents the sum of the vertical heights of five regular logs (6.25"), one locking log and one floor board laid atop the recess section of the locking log to form the floor.

Each stair stringer 650 is preferably fabricated from a single, solid piece of wood thereby making the stair stringer stronger than it would otherwise be if it were formed of separate pieces glued together. As shown in FIGS. 10A–10F, formed on an upwardly facing inclined portion of each stair stringer is a series of stair log seats 65 arranged successively from bottom to top in stepwise fashion. The vertical drop from one stair log seat to the next is generally one inch and the horizontal distance between each drop is preferably 1.25 inches. The first stair stringer 650*c* preferably has a horizontal dimension of 2.5 inches and a vertical dimension of 1.3125 inches. The third stair stringer 650*a* preferably has horizontal and vertical dimensions of 8.25 and 6.3125 inches, respectively.

Referring now to FIGS. 11A–11C, the stair logs 651 are designed to interlock with the stair log seats 65 of each stair stringer 650 so as to form a complete staircase. Each stair log 651 has flat top and bottom longitudinally extending sides with the top side preferably wider than the bottom side. The length between opposing ends of each stair log is preferably 3.25 inches with 0.9375 inches in height between the two opposing sides. The bottom side defines therein one notch symmetrically situated along its length. The wide flat top side of each stair log 651 constitutes the tread of a step whereas the notch of the bottom side interlocks with one of the stair log seats 65. Though each stair stringer 650 may itself serve as a staircase, it is presently preferred that a complete staircase be formed by interlocking one stair log 651 onto each of the stair log seats 65 of a given stair stringer 650. When interlocked in this manner, the vertical drop from the tread of one stair log to the next is approximately 1 inch and the horizontal distance between each drop is 1.25 inches.

The log assembly set further includes a plurality of plug logs 850 as illustrated in FIGS. 12A–12C. Primarily intended to be put to aesthetic use in erected structures, the plug logs are chiefly used to plug holes in the walls that may be formed by the longitudinal stacking of certain logs depending on the design of the structure to be built. This is best seen in FIG. 1. When the logs are stacked longitudinally such that the notches in the upper side of one log directly oppose the notches in the lower side of another log, holes are formed in the walls at intervals matching the preset separation length. Generally rectangular in shape, the holes measure twice the preset notch depth in height and obviously the preset notch length in length.

The plug logs 850 are each fabricated from a log of preferably 2.25 inches in length. Like each regular log, each plug log 850 has top and bottom longitudinally extending sides with the height between the two opposing sides being preferably 1.25 inches. From one end of each plug log, however, for a predetermined distance of preferably the preset notch length, material is cut from each of the top and bottom sides to a depth matching the preset notch depth. This leaves a plug log 850 having a plug end 85 that protrudes from a base end 58. A short plug log having an even shorter plug end is preferred when plugging holes against which the floor boards abut.

The plug end 85 so formed is generally rectangular in shape and is matched to fit and retain within any of the aforementioned holes. The base end 58 provide the illusion of a full log when the plug end is inserted into a hole. When plug logs 850 are inserted into all of the holes, the structure from an exterior perspective appears to have all logs performing a structurally useful purpose whereas in actuality the plug logs 850 are merely performing an aesthetic function. It should be noted that the filler logs 800 may also be used to perform this aesthetic function, though the filler logs 800 would have to be used to fill the holes as the walls are being constructed. The plug logs 850, however, can be used to fill the holes after the walls have been constructed.

The log based assembly set may optionally include a plurality of floor filler boards 601 and 602. The floor filler boards 601 shown in FIGS. 13A–13I are preferably 0.625 inches wide whereas the floor filler boards 602 shown in FIGS. 14A–14I are preferably 0.1875 inches wide. Each floor filler board is the preset dimension in height so as to fit flushly within the flat recess sections of the locking logs 140. The floor filler boards, moreover, come in three different lengths. The long floor filler boards 601*a* and 602*a* have a length equal to the long floor boards 600*a*. The medium floor filler boards 601*b* and 602*b* have a length equal to the medium floor boards 600*b*, and the short floor filler boards 601*c* and 602*c* have a length equal to the short floor boards 600*c*. The floor filler boards are generally to be used for the same purposes as floor boards 600. Their primary purpose is to provide the builder with a choice in the type and appearance of the flooring used in whatever type of structure one wishes to build with the invention.

In the presently preferred embodiment of the log based assembly set, a wide variety of structures with an assortment of features may be built from the pluralities of components enumerated in Table I. Traditional one room log cabins and several story, multi-sectional houses are typical of the structures that can be erected. The invention can also be used to build somewhat atypical structures such as end tables, ottomans and bookshelves. By adding even more components or using two or more such sets, even more structures of even greater variety in design may be constructed. Various components such as filler logs 800, stair logs 651 and plug logs 850 may also be used for purposes that will become apparent after the consumer becomes experienced in erecting structures with the invention. It should also be apparent that though the preferred dimensions for each of the components of the invention have been set forth in this document, the following claims are intended to cover log assembly sets whose components have dimensions reduced or increased proportionately in size.

The presently preferred embodiment for carrying out the invention has been set forth in detail according to the Patent Act. Those persons of ordinary skill in the art to which this invention pertains may nevertheless recognize various alternative ways of practicing the invention without departing from the spirit and scope of the following claims. Those of such skill will also recognize that the foregoing description is merely illustrative and not intended to limit any of the ensuing claims to any particular narrow interpretation.

Accordingly, to promote the progress of science and the useful arts, we secure for ownselves by Letters Patent exclusive rights to all subject matter embraced by the following claims for the time prescribed by the Patent Act.

I claim:

1. A log assembly set for constructing a wide variety of structures, said log assembly set comprising:

(a) floor plate logs each having first and second longitudinally extending sides, said first side defining therein at least two notches situated symmetrically such that said at least two notches are spaced a preset separation length apart by a middle section of said floor plate log and approximate respective ends of said floor plate log said notches are spaced a preset end length therefrom, said second side being uniformly flat;

(b) regular logs each having first and second longitudinally extending sides, said first and said second sides each defining therein at least two notches situated symmetrically such that each of said notches on said first side aligns with one of said notches on said second side so as to form at least two pairs of aligned notches in said regular log and such that said at least two pairs of notches are spaced said preset separation length apart by a middle section of said regular log and approximate respective ends of said regular log said pairs of notches thereabout are spaced said preset end length therefrom;

(c) locking logs each having first and second longitudinally extending sides, said first and said second sides each defining therein at least two notches situated symmetrically such that each of said notches on said first side aligns with one of said notches on said second side so as to form at least two pairs of aligned notches in said locking log and such that said at least two pairs of notches are spaced said preset separation length apart by a middle section of said locking log and approximate respective ends of said locking log said pairs of notches thereabout are spaced said preset end length therefrom, each said locking log further defining in said middle section on said first side a flat recess section therein; said floor plate, regular and locking logs for connecting at right angles to each other via mutual interfacing of said notches so as to construct walls wherein said logs lie generally longitudinally one atop another;

(d) gable pieces each having a generally triangular shape with a flat top edge, a flat bottom, and two flat sloping sides at an acute angle to said bottom and an obtuse angle to said top edge, said top edge defining therein one notch situated symmetrically therealong and said bottom defining therein at least two notches situated symmetrically such that said at least two notches are spaced said preset separation length apart by a middle section of said bottom and approximate respective ends of said bottom said notches thereabout are spaced said preset end length therefrom, thereby rendering each of said gable pieces connectable to said logs atop said walls;

(e) floor boards for forming flooring between a pair of opposed walls, each of said opposed walls having disposed therein at least one of said locking logs such that each of said locking logs disposed in one of said opposed walls is coplanar with one of said locking logs disposed in the other of said opposed walls, each of said floor boards having as a height a preset dimension matched to fit within said flat recess sections of said locking logs so that respective ends of each said floor board lockingly retain in said opposing walls within said recess sections of said locking logs so coplanarly disposed;

(f) roof boards each for situating atop at least said sloping sides of said gable pieces to form a roof; and (g) a means for retaining said roof boards upon said sloped sides of said gable pieces.

2. The log assembly set as recited in claim 1 wherein said notches of all of said logs in said log assembly set have in common both a preset notch length and a preset notch depth, said preset notch depth of approximately one quarter of the distance as measured between said first and said second sides of one of said regular logs.

3. The log assembly set as recited in claim 1 wherein said floor boards may also be used in forming at least one of a balcony, a loft, a shelf, a terrace and like elevated features in conjunction with said recess sections of said locking logs disposed in said opposing walls.

4. The log assembly set as recited in claim 1 wherein said roof retaining means includes an adhesive.

5. The log assembly set as recited in claim 1 wherein said roof retaining means includes:

(a) a plurality of locking pegs; and (b) an aperture defined within each of said sloping sides of said gable pieces approximate the vertex of said acute angle, each of said apertures sized to permit snug fitting of one of said locking pegs therein so as to prevent said roof boards from sliding off said sloping sides by either fitting in an orifice defined in said roof boards or serving merely as an abutment.

6. The log assembly set as recited in claim 1 wherein said floor boards are each shorter by about thrice said preset end length than said logs of said walls that said floor boards are disposed in parallel with so that said floor boards span between said opposing walls via said flat recess sections of said locking logs so coplanarly disposed.

7. The log assembly set as recited in claim 1 wherein said floor boards are each of a preferred width equal to said preset separation length divided by an integer so that said integer number of said floor boards laid flat adjacently to each other match said preset separation length.

8. The log assembly set as recited in claim 1 wherein said roof boards have a length to allow said roof boards to overhang from said gable pieces of said roof.

9. The log assembly set as recited in claim 1 wherein said gable pieces are each formed from at least two angle ended logs stacked longitudinally one atop another, each of said angle ended logs having:

(a) first and second longitudinally extending sides; and (b) two equal-angled ends at said acute angle to said second side and said obtuse angle to said first side; such that said second side of one angle ended log has a length equal to and stacks longitudinally atop said first side of another angle ended log such that said angled ends of each of said angle ended logs are aligned flushly at respective ends so as to form said flat sloping sides of said gable piece, said first side of a topmost angle ended log constitutes said flat top edge of said gable piece, and said second side of a bottommost angle ended log constitutes said flat bottom of said gable piece.

10. The log assembly set as recited in claim 1 further comprising filler logs each having first and second longitudinally extending sides, said first and said second sides each defining therein one notch situated symmetrically such that said notch on said first side aligns with said notch on said second side so as to form one pair of aligned notches in said filler log and such that said pair of notches is spaced said preset end length from each end of said filler log.

11. The log assembly set as recited in claim 1 further comprising plug logs each having first and second longitudinally extending sides and opposing ends such that from one of said opposing ends for a predetermined distance material is absent from both of said sides to a depth matching said preset notch depth thereby forming a plug portion generally rectangular in shape and matched to retain within plug holes formed when two of said logs are disposed longitudinally one atop another such that a notch on a lower side of one log directly opposes a notch on an upper side of another log.

12. The log assembly set as recited in claim 1 further comprising a plurality of staircases each having:

(a) a stair stringer disposed to span two levels of a structure, said stair stringer featuring on its upward facing inclined side a series of stair log seats arranged successively in stepwise fashion from bottom to top; and (b) a stair log for each of said stair log seats, said stair logs each having top and bottom longitudinally extending sides with said top side constituting the tread of a step and said bottom side defining therein one notch symmetrically situated along its length for interlocking with one of said stair log seats to form one step of said staircase.

13. The log assembly set as recited in claim 1 further comprising ridge logs each having first and second longitudinally extending sides, said first side defining therein at least two notches situated symmetrically such that said at least two notches are spaced said preset separation length apart by a middle section of said ridge log and approximate respective ends of said ridge log said notches thereabout are spaced said preset end length therefrom, said ridge logs at least for interconnecting said top edges of said gable pieces disposed opposite each other at an apex of said roof.

14. A log assembly set for constructing a variety of structures, said log assembly set comprising:

(a) floor plate logs each having first and second longitudinally extending sides, said first side defining therein at least two notches situated symmetrically such that said at least two notches are spaced a preset separation length apart by a middle section of said floor plate log and approximate respective ends of said floor plate log said notches thereabout are spaced a preset end length therefrom, said second side being uniformly flat;

(b) regular logs each having first and second longitudinally extending sides, said first and said second sides each defining therein at least two notches situated symmetrically such that each of said notches on said first side aligns with one of said notches on said second side so as to form at least two pairs of aligned notches in said regular log and such that said at least two pairs of notches are spaced said preset separation length apart by a middle section of said regular log and approximate respective ends of said regular log said pairs of notches thereabout are spaced said preset end length therefrom;

(c) locking logs each having first and second longitudinally extending sides, said first and said second sides each defining therein at least two notches situated symmetrically such that each of said notches on said first side aligns with one of said notches on said second side so as to form at least two pairs of aligned notches in said locking log and such that said at least two pairs of notches are spaced said preset separation length apart by a middle section of said locking log and approximate respective ends of said locking log said pairs of notches thereabout are spaced said preset end length therefrom, each said locking log further defining in said middle section on said first side a flat recess section therein; said floor plate, regular and locking logs for connecting at right angles to each other via mutual interfacing of said notches so as to construct walls wherein said logs lie generally longitudinally one atop another;

(d) gable pieces each having a generally triangular shape with a flat top edge, a flat bottom, and two equal flat sloping sides at an acute angle to said bottom and an obtuse angle to said top edge, said top edge defining therein one notch situated symmetrically therealong and said bottom edge defining therein at least two notches situated symmetrically such that said at least two notches are spaced said preset separation length apart by a middle section of said bottom and approximate respective ends of said bottom said notches thereabout are spaced said preset end length therefrom thereby rendering said notches of said gable pieces connectable with said notches of said logs;

(e) ridge logs each having first and second longitudinally extending sides, said first side defining therein at least two notches situated symmetrically such that said at least two notches are spaced said preset separation length apart by a middle section of said ridge log and approximate respective ends of said ridge log said notches thereabout are spaced said preset end length therefrom, said ridge logs for at least interconnecting said top edges of said gable pieces;

(f) floor boards for forming flooring between a pair of opposed walls, each of said opposed walls having disposed therein at least one of said locking logs such that each of said locking logs disposed in one of said opposed walls is coplanar with one of said locking logs disposed in the other of said opposed walls, each of said floor boards having as a height a preset dimension matched to fit within said flat recess sections of said locking logs so that respective ends of each said floor board lockingly retain in said opposing walls within said recess sections of said locking logs so coplanarly disposed;

(g) roof boards each for situating atop at least said sloping sides of said gable pieces to form a roof; and (h) a means for retaining said roof boards upon said sloped sides of said gable pieces.

15. The log assembly set as recited in claim 14 further comprising a plurality of staircases each having:

(a) a stair stringer disposed to span two levels of a structure, said stair stringer featuring on its upward facing inclined side a series of stair log seats arranged successively in stepwise fashion from bottom to top; and (b) a stair log for each of said stair log seats, said stair logs each having top and bottom longitudinally extending sides with said top side constituting the tread of a step and said bottom side defining therein one notch symmetrically situated along its length for interlocking with one of said stair log seats to form one step of said staircase.

16. An elongated locking log useful as a member of a log assembly set, such log assembly set composed of multiple elongated log-like members which connect perpendicularly to each other via mutual interfacing of notches symmetrically disposed in at least one of first and second longitudinally extending sides of each such log-like member so as to construct walls of a structure, each of such notches spaced by a middle section a preset separation length apart with one of such notches spaced by an end section a preset end length from each end of such log-like member along such at least one of first and second opposing sides, such notches spaced to permit interlocking of such log-like members so that such log-like members stack one longitudinally atop another to form such walls, said locking log comprising:

(a) first and second opposing sides extending longitudinally along said locking log, said first and said second sides each defining therein at least two notches situated symmetrically such that each of said notches on said first side aligns with one of said notches on said second side so as to form at least two pairs of aligned notches in said locking log;

(b) an end section situated at each end of said locking log, each of said end sections having said preset end length and situated adjacent to one of said pairs of opposed notches; and (c) a middle section having said preset separation length situated between each of said pairs of aligned notches, said middle section on said first side defining a flat recess section therein; thereby rendering said locking logs incorporatable into such walls of such structure such that when one of said locking logs is incorporated into each of two such walls that oppose each other so that said locking logs are disposed coplanarly with respect to each other, flooring can be lockingly retained via said recess sections of said locking logs with each end of such flooring being retained between said middle section defining said flat recess section of said locking log and such middle section of one of such first and such second opposing sides of one of such log-like members.

17. The locking log as recited in claim 16 wherein said notches of said locking log and such notches of such log-like members have in common both a preset notch length and a preset notch depth thereby enabling said logs and such log-like members to lie generally contiguously one longitudinally atop another in such walls.

18. The locking log as recited in claim 16 wherein said flat recess section is a preset dimension in depth matched to the thickness of such flooring.

19. A combination of stair stringers and stair logs useful as members of a log assembly set for forming a staircase spanning two levels of a structure, such log assembly set composed of multiple elongated log-like members which connect perpendicularly to each other via mutual interfacing of notches symmetrically disposed in at least one of first and second opposing longitudinally extending sides of each such log-like member so as to construct walls of such structure, such notches spaced to permit interlocking of such log-like members so that such log-like members stack one longitudinally atop another to form such walls, said stair stringer comprising:

(a) a base portion which situates upon a lower one of such two levels; and (b) an upwardly facing inclined portion extending from said base portion to an upper one of such two levels, said inclined portion having a series of stair log seats arranged successively in stepwise fashion from bottom to top; and (c) a stair log for each of said stair log seats, each said stair log having a top and a bottom longitudinally extending side with said top side constituting the tread of a step and said bottom side defining therein one notch symmetrically situated along its length, each said stair log for interlocking with one of said stair log seats via said notch on said bottom side thereof.

* * * * *